US008053153B2

(12) United States Patent
Kouyama et al.

(10) Patent No.: US 8,053,153 B2
(45) **Date of Patent: *Nov. 8, 2011**

(54) TONER FOR DEVELOPING ELECTROSTATIC LATENT IMAGE

(75) Inventors: Mikio Kouyama, Kunitachi (JP); Kenji Hayashi, Hachioji (JP); Tomoko Sakimura, Hino (JP); Hiroyuki Yasukawa, Hachioji (JP); Hiroaki Obata, Hino (JP); Natsuko Kusaka, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 425 days.

This patent is subject to a terminal disclaimer.

(21) Appl. No.: 12/267,030

(22) Filed: Nov. 7, 2008

(65) Prior Publication Data

US 2009/0123861 A1 May 14, 2009

(30) Foreign Application Priority Data

Nov. 14, 2007 (JP) ..... 2007-295306

(51) Int. Cl.
*G03G 9/00* (2006.01)

(52) U.S. Cl. ..... 430/108.23; 430/108.24

(58) Field of Classification Search ..... 430/108.23, 430/108.24

See application file for complete search history.

(56) References Cited

U.S. PATENT DOCUMENTS 3,094,536 A * 6/1963 Kenney et al. ..... 540/128
4,518,672 A * 5/1985 Urawa et al. ..... 430/108.21
6,472,523 B1 * 10/2002 Banning et al. ..... 540/128
2004/0043319 A1 * 3/2004 Horiuchi et al. ..... 430/137.14

FOREIGN PATENT DOCUMENTS

JP 11-212303 A 8/1999

* cited by examiner

*Primary Examiner* — Thorl Chea
(74) *Attorney, Agent, or Firm* — Buchanan Ingersoll & Rooney, P.C.

(57) ABSTRACT

An electrophotographic toner containing a resin and a colorant is disclosed. The colorant is represented by the formula in the formula, $M_1$ is a silicon atom (Si), a germanium atom (Ge) and a tin atom (Sn); Z is independently a chlorine atom, a hydroxy group, an alkoxy group having 1 to 8 carbon atoms, or an aryloxy group having 6 to 8 carbon atoms; and $A^1$, $A^2$, $A^3$ and $A^4$ are each independently an atomic group defined in the specification.

8 Claims, 2 Drawing Sheets

TONER FOR DEVELOPING ELECTROSTATIC LATENT IMAGE

This application is based on Japanese Patent Application No. 2007-295306 filed on Nov. 14, 2007, the entire content of which is hereby incorporated by reference.

TECHNICAL FIELD

The present invention relates to electrostatic latent image developing toners for use in electrophotographic image formation.

TECHNICAL BACKGROUND

An image forming method of a color electrophotographic method has become popular in a color composite apparatus for office use and a laser printer and expands to a color production printing market recently. Printed matters are sold as itself by small and medium printer makers in the color reproduction area, which is usually distinguished from the office use market. The demand to image characteristics such as color reproduction is severe since color tone of a merchandise photography relates to a sales amount directly.

JAPAN COLOR Reproduction Print 2001 is adopted as a standard color in the printing area, by which improves communication between print makers. Primary object for the electrophotographic image forming method has been to reproduce the JAPAN Color 2001, and major electrophotographic image forming apparatus manufactures are successful to cover the color reproduction area recently.

However, further expansion of color reproduction area is demanded by uses since an editing image on display is different from relatively narrow the CLOR JAPAN color reproduction area according to development of digital image input apparatus such as high specification digital camera or display technique.

This requires the accomplishment of color area and color reproduction of transparent display standard S-RGB, and for this purpose a new colorant is required. The S-RGB is a standard established by IEC (International Electrotechnical Commission) on October 0998. It is a representing formula to reproduce intended color regardless the species of personal computers, or display or printer machines. Particularly expansion of secondary chroma of green and blue area is required and new means to accomplish it is required.

While copper phthalocyanine colorant has been popular for cyan colorant, it is insufficient because of low chroma and transparency. Though a cyan dye is proposed as disclosed in Patent Document 1 to dissolve the problem, it is problematic in heat resistance, for example, there is observed color tone change in which blue is enhanced when fixing temperature raises.

Patent Document 1: JP A H11-212303

SUMMARY OF THE INVENTION

An object of this invention is to provide a cyan toner for an electrophotography having high brightness, good tone and minimized color change due to fixing temperature variation.

One aspect of the invention is directed to an electrophotographic toner comprising toner particles each containing a resin and a colorant, wherein the colorant comprises a compound represented by the formula (I):

formula (I)

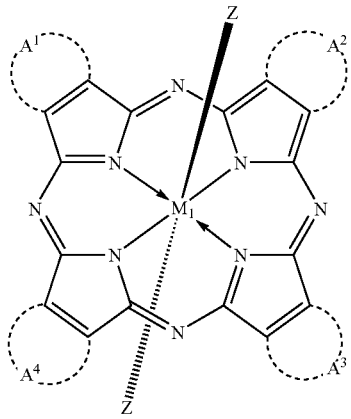

In the formula, $M_1$ is a silicon atom (Si), a germanium atom (Ge) or a tin atom (Sn); Z is independently a chlorine atom, a hydroxy group, an alkoxy group having 1 to 8 carbon atoms, or an aryloxy group having 6 to 8 carbon atoms; and $A^1$, $A^2$, $A^3$ and $A^4$ are each independently an atomic group shown below:

(a-1)

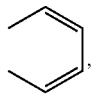

(a-2)

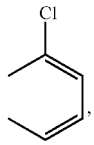

(a-3)

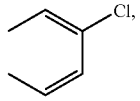

(a-4)

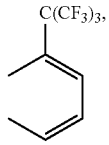

(a-5)

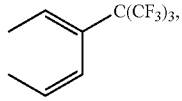

(a-6)

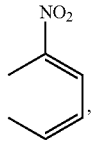

(a-7)

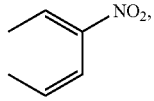

-continued (a-8)

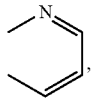

(a-9)

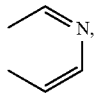

(a-10)

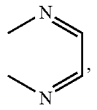

(a-11)

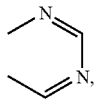

(a-12)

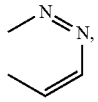

(a-13)

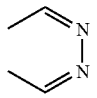

The groups (a-1) through (a-7) are preferably employed, and the groups (a-1) through (a-4) are more preferably employed.

Preferable example of $M_1$ is a silicon atom (Si)

Preferable example of Z is a chlorine atom, a hydroxy group, or an alkoxy group having 1 to 5 carbon atoms.

The toner of this invention may be applied to an image forming method.

An electrophotographic cyan toner and an image forming method, exhibiting good color tone with high brightness, high chroma and minimized tone change even when fixing temperature changes, can be provided by this invention.

DETAILED DESCRIPTION OF THE INVENTION

Figure 1:
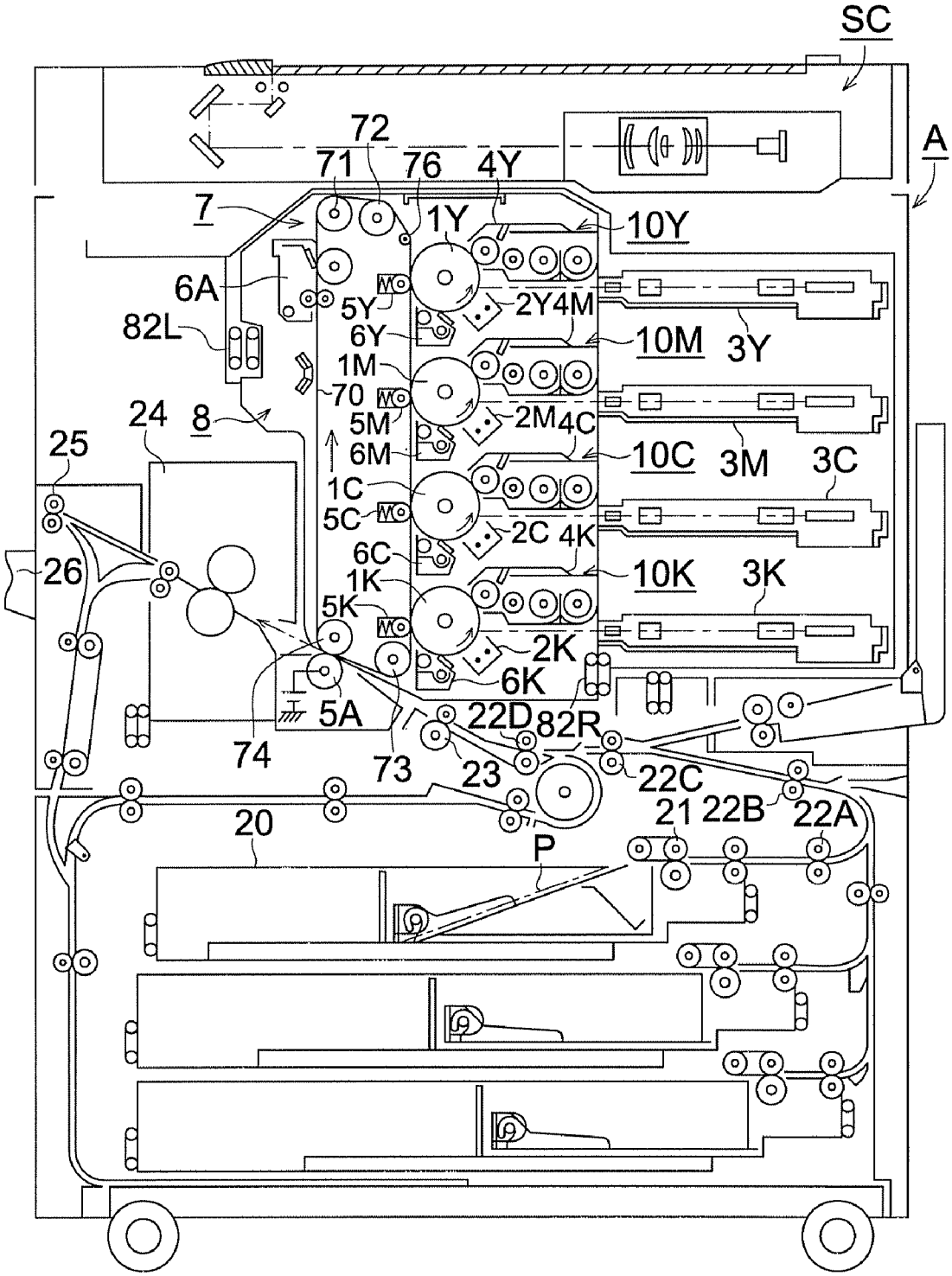
FIG. 1 illustrates an example of a tandem type full-color image forming apparatus in which image formation of a two-component development system is feasible.

The present invention will be further described in detail.

The colorant having a phthalocyanine ring and a toner employing this colorant has enabled to provide color prints exhibiting good color tone with high brightness of light blue and high chroma of light blue. The toner has also enabled to provide color prints exhibiting good color tone without change of cyan color even when temperature of fixing device changes in excess.

The reason to have good chroma, tone characteristics and anti-heating characteristics is guessed that the absorption spectrum of the colorant is sharp because covalent bond property between the center atom and phthalocyanine ring is relatively strong, and crystal type does not easily change due to heating since the compound has a specific substituent whereby the crystal type is stable.

$M_1$ in the formula (I) is Si, Ge or Sn, and Si is preferable among them. The atomic groups represented by A1, A2, A3 and A4 each is selected from (a-1) through (a-13) to obtain preferable color area of light blue and blue.

The substituent Z bonding to M1 is independently a chlorine atom, a hydroxy group, an alkoxy group having 1-8 carbon atoms, or an aryloxy group having 6-8 carbon atoms. A preferable example includes a chlorine atom, a hydroxy group, and an alkoxy group having 1-5 carbon atoms, in view of heat resistance, particularly.

Representative examples are listed.

I-1

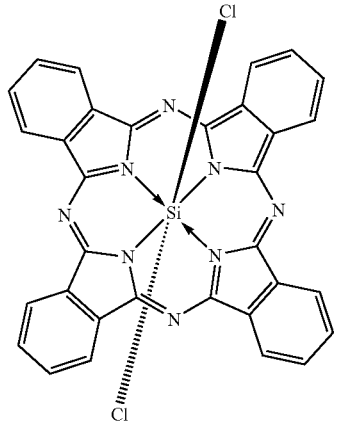

I-2

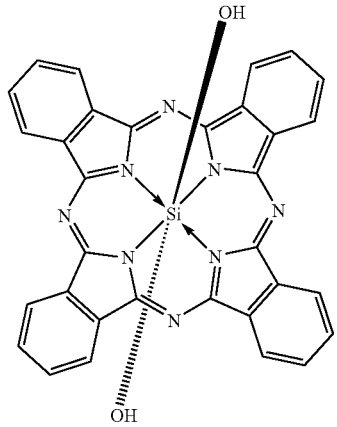

I-3

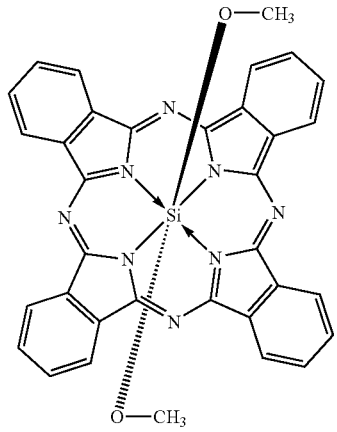

-continued
I-4
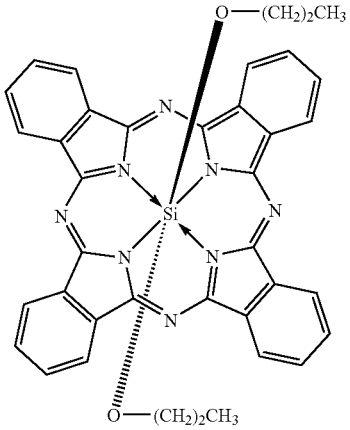
I-5
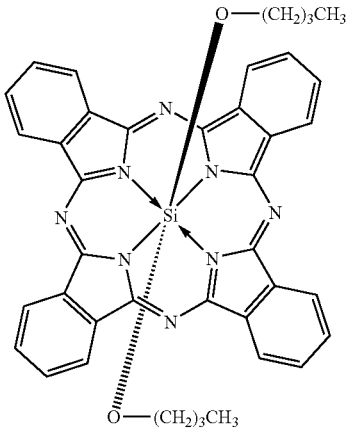
I-6
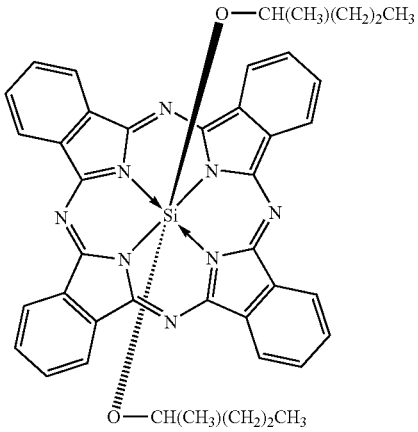
-continued
I-7
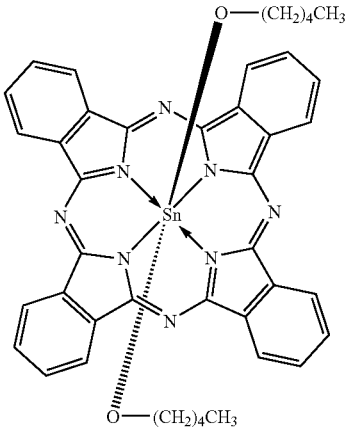
I-8
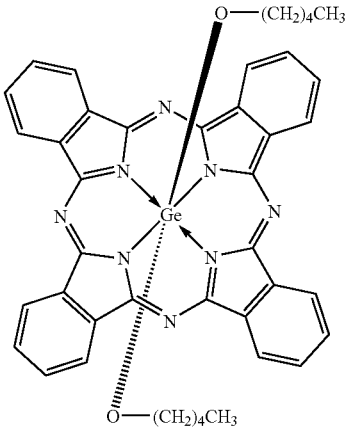
I-9
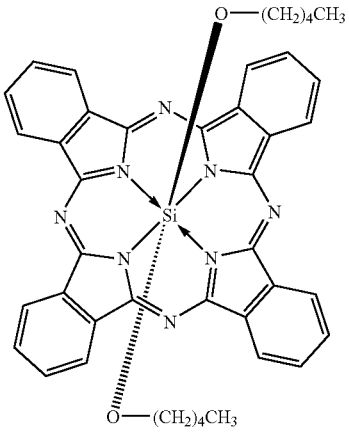

-continued
I-10
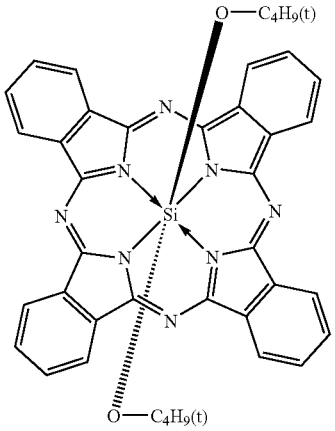
I-11
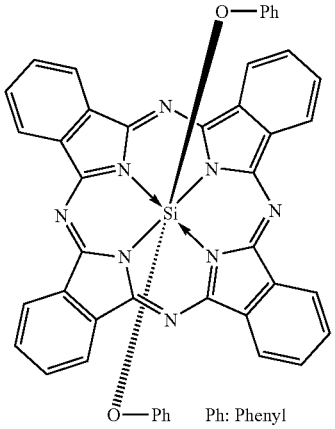
Ph: Phenyl
I-12
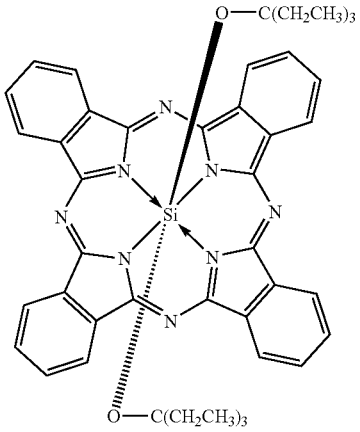
-continued
I-13
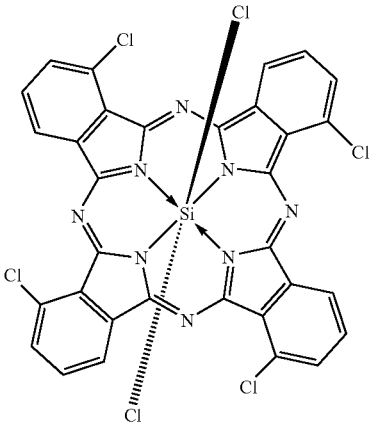
I-14
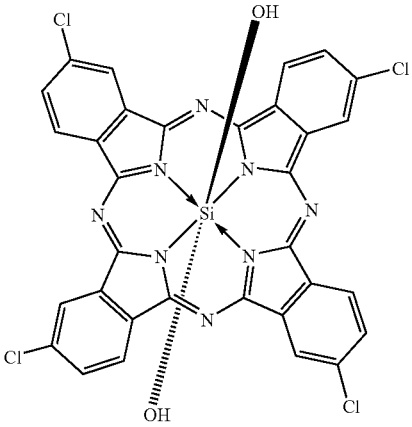
I-15
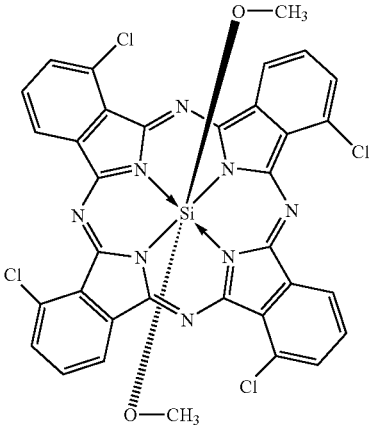

-continued
I-16
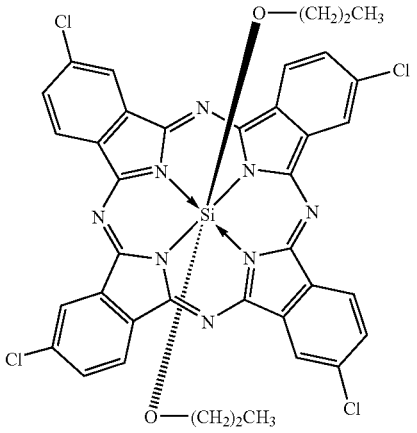
I-17
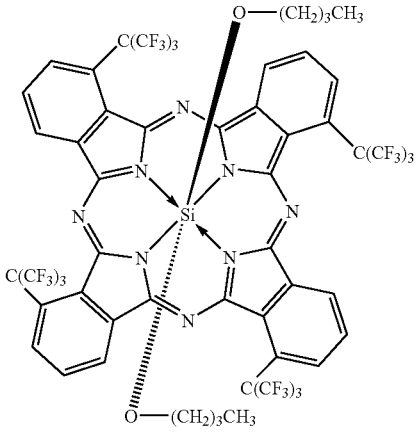
I-18
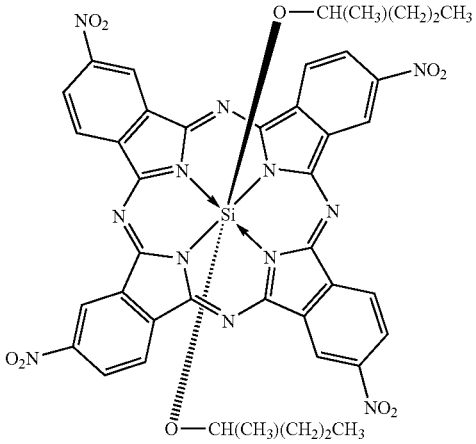
-continued
I-19
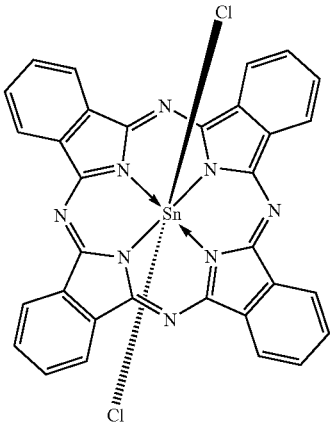
I-20
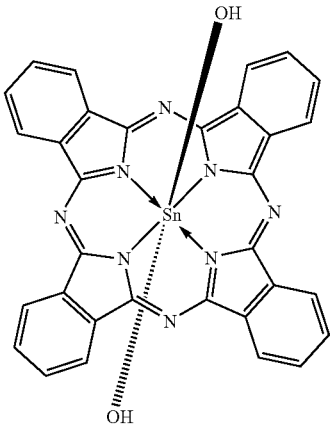
I-21
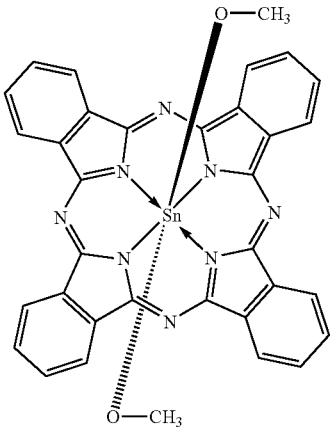

-continued
I-22
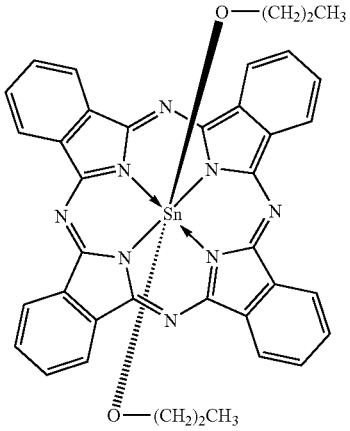
I-23
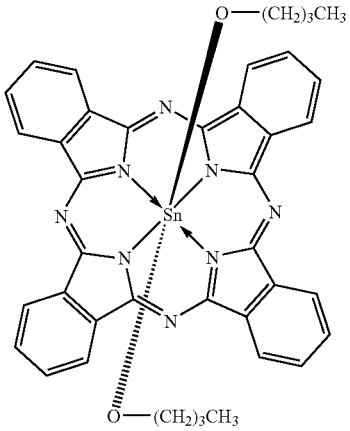
I-24
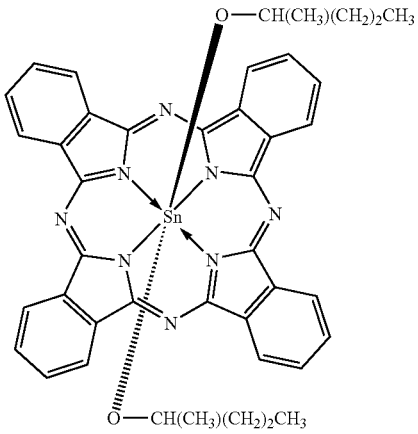
-continued
I-25
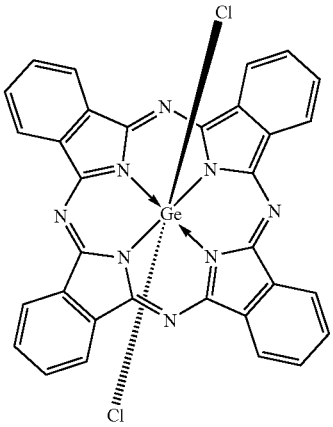
I-26
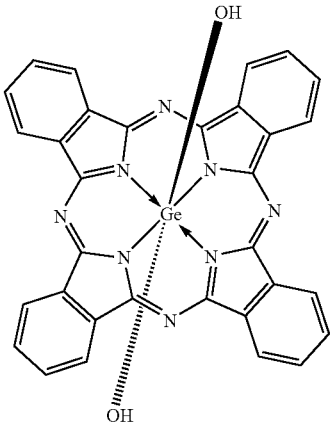
I-27
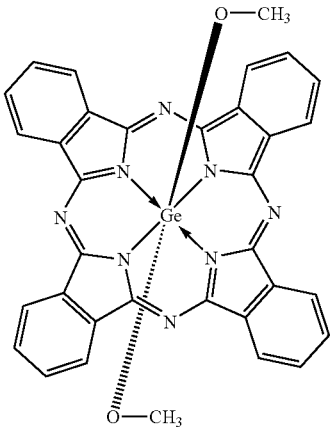

-continued

I-28

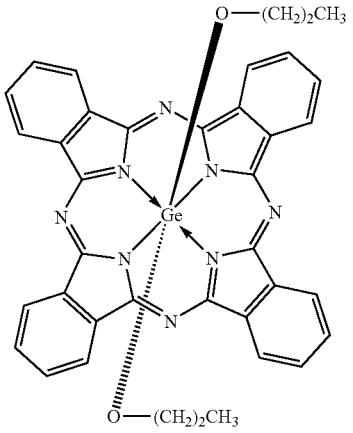

I-29

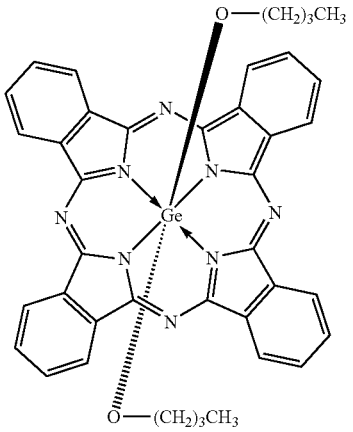

I-30

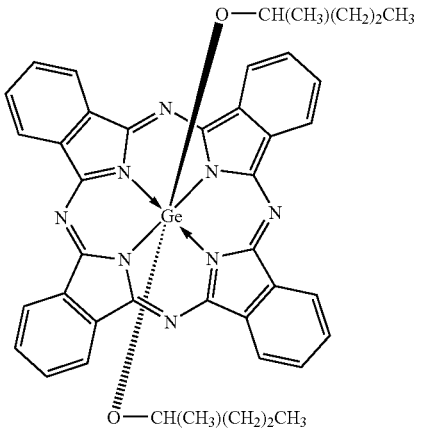

The compounds (I-1) through (I-6) are preferably employed among them.

In the invention, the content of the colorant represented by the formula (I) is preferably from 2 to 10% by mass of the total of a toner, and more preferably from 4 to 8% by mass.

Particle diameter of the colorant in a toner particle is preferably 24-1600 nm, more preferably 60-700 nm. The particle diameter of the colorant is expressed by an arithmetic average of FERE diameter of 200 colorant particles of a sample of 100 nm thickness cut out by a ultra microtome, observed by transparent electronmicroscope.

Compounds of formula (I) can be prepared according to known methods disclosed in the following literatures. First, preparation methods of tetrazaporphin compounds represented by formula (I) (which are phthalocyanine compounds having ligands) can be referred to the following patent documents: U.S. Pat. Nos. 5,428,152, 4,927,735, 5,021,563, 5,219,706, 5,034,309, 5,284,943, 5,075,203, 5,484,685, 5,039,600, 5,438,135 and 5,665,875.

Toner of the Invention

Preparation method of toner includes a dry method such as a pulverization method, and a wet method such as a suspension polymerization method, an emulsion association method and a dissolution suspension method. The crush method and the emulsion association method are preferably employed in this invention in view of transparency of toner, particularly controlling a particle diameter of a colorant microparticle in a toner particle.

There will be further described particle size of the toner of the invention.

Toner particles relating to the invention preferably exhibit a volume-based median diameter (also denoted simply as D50v) of not less than 3 μm and not more than 8 μm. The volume-based median diameter falling within the foregoing region enables faithful reproduction of fine-dot images.

The volume-based median diameter (D50v) of toner particles can be determined using COULTER MULTISIZER 3 (Beckmann Coulter, Inc.), connected to a computer system for data processing.

The measurement procedure is as follows: 0.02 g of toner particles are added to 20 ml of a surfactant solution (for example, a surfactant solution obtained by diluting a surfactant containing neutral detergent with pure water to a factor of 10) and dispersed by an ultrasonic homogenizer to prepare dispersion toner particles. Using a pipette, the toner dispersion is poured into a beaker having ISOTON II (produced by Beckman Coulter, Inc.) within a sample stand, until reaching a measurement concentration of 5 to 10%. The measurement count was set to 2,500 to perform measurement. Then aperture diameter of MULTISIZER 3 was 50 μm.

The toner of the invention preferably exhibits a coefficient of variation (CV value) of volume-based particle size distribution of not less than 2% and not more than 21%, more preferably not less than 5% and not more than 15%.

The coefficient of variation (CV value) of volume-based particle size distribution represents a dispersion degree of particle size distribution, based on volume and defined as below:

*CV* value (%)={(standard deviation of volume-based particle size distribution)/[median diameter (D50v) of volume-based particle size distribution]}×100

A low value indicates a sharper particle size distribution and means that the particle size tends to be uniform. Developing efficiency and transfer efficiency becomes higher in the developing and transfer process when the particle size distribution becomes sharp since particle size is proportional to charge quantity of the toner particle. Toner scattering near the fine dot image or fine line required in digital image forming appears and it results unclear edge when the particle size and charge quantity becomes uniform enough. Therefore, it is preferable to control the particle size distribution to have above mentioned CV value.

Softening Point, Glass Transition Point, Molecular Weight Distribution

The toner of the invention preferably exhibits a softening point at a temperature of 75 to 112° C., more preferably 80 to 105° C., and more preferably 85 to 98° C. The softening point cab controlled by molecular weight distribution of binder resin, and top peak of GPC is set as about 10,000-12,000, and glass transition point temperature set as 10-44° C., preferably 25-38° C. The glass transition point temperature can be controlled by monomer proportion such as butylacrylate, and 2-ethylhexylacrylate in case of styrene/acryl resin. The glass transition point temperature can be controlled by selecting adduct number of ethyleneoxide or propylene oxide adduct to bisphenol A as 3 or more, or selecting number of carbon atoms of an aliphatic alkylenediol as 4 to 18 in case of polyester resin.

The colorant employed in a toner of this invention has stable characteristics that a spectrum does not change when it is suffered from heat, and thermal energy required for fixing can be reduced by setting the softening point of the binder resin as described above.

The softening point of a toner can be controlled by the following methods, singly or in combination. Thus, (1) the kind or the composition of monomer used for resin formation is adjusted; (2) the molecular weight of a resin is controlled by the kind or the amount of a chain-transfer agent; (3) the kind or amount of a wax is controlled.

The softening point of a toner may be measured by using, for example, Flow Tester CFT-500 (produced by Shimazu Seisakusho Co., Ltd.). Specifically, a sample which is molded to a 10 mm high column, is compressed by a plunger at a load of $1.96\times10^6$ Pa with heating at a temperature rising rate of 6° C./min and extruded from a 1 mm long nozzle, whereby, a curve (softening flow curve) between plunger-drop and temperature is drawn. The temperature at which flowing-out is initiated is defined as the fusion-initiation temperature and the temperature corresponding to 5 mm drop is defined as the softening temperature.

There will be described a method of preparing the toner of the invention.

The toner of the invention is comprised of particles containing at least a resin and a colorant (hereinafter, also denoted as colored particles). The colored particles constituting the toner of the invention are not specifically limited but can be prepared according the convention methods for preparing toners. More specifically, preparation is feasible by applying, for example, a so-called grinding method for preparing a toner through kneading, grinding and classification or a preparation method of a polymer toner in which a polymerizable monomer is polymerized with controlling the shape or size of particles to achieve particle formation (for example, emulsion polymerization, suspension polymerization, or polyester elongation).

When preparing the toner of the invention through a pulverization method, kneading is performed with maintaining a temperature at not more than 130° C. When kneading a mixture at a temperature exceeding 130° C., heating action applied to the mixture tends to cause variation in the coagulation state of a colorant, rendering it difficult to maintain uniform colorant coagulation. It is a concern that variation in the coagulation state causes variations in color of the prepared toner, leading to color contamination.

Next, there will be described resin and wax constituting the toner of the invention, with reference to examples.

Resins usable for the toner of the invention are not specifically limited but are typically polymers formed by polymerization of polymerizable monomers which are called vinyl monomers. A polymer constituting a resin usable in the invention is constituted of a polymer obtained by polymerization of at least one polymerizable monomer, which is a polymer prepared by using vinyl monomers singly or in combination.

Specific examples of a polymerizable vinyl monomer are below:

(1) Styrene or Styrene Derivatives:

styrene, o-methylstyrene, m-methylstyrene, p-methylstyrene, α-methylstyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene;

(2) Methacrylic Acid Ester Derivatives:

methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate;

(3) Acrylic Acid Ester Derivatives:

methyl acrylate, ethyl acrylate, iso-propyl acrylate, n-butyl acrylate, t-butyl acrylate, iso-butyl acrylate, n-octyl acrylate, 2-ethylhexyl acrylate, stearyl acrylate, lauryl acrylate and phenyl acrylate;

(4) Olefins:

ethylene, propylene and isobutylene;

(5) Vinyl Esters:

vinyl propionate, vinyl acetate and vinyl benzoate;

(6) Vinyl Ethers:

vinyl methyl ether and vinyl ethyl ether;

(7) Vinyl Ketones:

vinyl methyl ketone, vinyl ethyl ketone and vinyl hexyl ketone;

(8) N-Vinyl Compounds:

N-vinyl carbazole, N-vinyl indole and N-vinyl pyrrolidone;

(9) Others:

vinyl compounds such as vinylnaphthalene and vinylpyridine; acrylic acid or methacrylic acid derivatives such as acrylonitrile, methacrylonitrile and acrylamide.

There may also usable polymerizable monomers containing ionic-dissociative group, as a vinyl monomer, including, for example, those having a side chain containing a functional group such as a carboxyl group, a sulfonic acid group or a phosphoric acid group.

Specific examples include carboxyl group containing monomers such as acrylic acid, methacrylic acid, maleic acid, itaconic acid, cinnamic acid, fumaric acid, monoalkyl maleate, monoalkyl itaconate; sulfonic acid group containing monomers such as styrenesulfonic acid, allylsulfosuccinic acid, 2-acrylamido-2-methylpropanesulfonic acid; and phosphoric acid group containing monomers such as acid phosphooxyethyl methacrylate.

Further, a cross-linked resin can be obtained using polyfunctional vinyls such as divinylbenzene, ethylene glycol dimethacrylate, ethylene glycol diacrylate, triethylene glycol dimethacrylate, triethylene glycol diacrylate, neopentylglycol dimethacrylate and neopentylglycol diacrylate.

Waxes usable in the toner of the invention are those known in the art. Examples thereof include (1) polyolefin wax such as polyethylene wax and polypropylene wax;

(2) long chain hydrocarbon wax such as paraffin wax and sasol wax;

(3) dialkylketone type wax such as distearylketone;

(4) ester type wax such as carnauba wax, montan wax, trimethylolpropane tribehenate, pentaerythritol tetramyristate, pentaerythritol tetrabehenate, pentaerythritol diacetate dibehenate, glycerin tribehenate, 1,18-octadecanediol distearate, trimellitic acid tristearate, and distearyl meleate; and (5) amide type wax such as ethylene bisdibehenylamide and steric acid stearylamide.

The melting point of a wax usable in the invention is preferably 40 to 125° C., more preferably 50 to 120° C., and still more preferably 60 to 90° C. A melting point falling within the foregoing range ensures heat stability of toners and can achieve stable toner image formation without causing cold offsetting even when fixed at a relatively low temperature. The wax content of the toner is preferably in the range of 1% to 30% by mass, and more preferably 5% to 20%.

There may be incorporated, in the process of preparing the toner of the invention, inorganic organic microparticles having a number-average primary particle size of 4 to 800 nm as an external additive to prepare the toner.

Incorporation of an external additive results in improved fluidity or electrostatic property or achieves enhanced cleaning ability. The kind of external additives is not specifically limited and examples thereof include inorganic microparticles, organic microparticles and a sliding agent, as described below.

There are usable commonly known inorganic microparticles and preferred examples thereof include silica, titania, alumina and strontium titanate microparticles. There may optionally be used inorganic microparticles which have been subjected to a hydrophobilization treatment.

Specific examples of silica microparticles include R-805, R-976, R-974, R-972, R-812 and R-809 which are commercially available from Nippon Aerosil Co., Ltd.; HVK-2150 and H-200 which are commercially available from Hoechst Co.; TS-720, TS-530, TS-610, H-5 and MS-5 which are commercially available from Cabot Co.

Examples of titania microparticles include T-805 and T-604 which are commercially available from Nippon Aerosil Co. Ltd.; MT-100S, MT-100B, MT-500BS, MT-600, MT-600Ss, JA-1 which are commercially available from Teika Co.; TA-300SI, TA-500, TAF-130, TAF-510 and TAF-510T which as commercially available from Fuji Titanium Industry Co., Ltd.; IT-S, IT-OB and IT-OC which as commercially available from Idemitsu Kosan Co., Ltd.

Examples of alumina microparticles include RFY-C and C-604 which are commercially available from Nippon Aerosil Co., Ltd.; and TTO-55, commercially available from Ishihara Sangyo Kaisha, Ltd.

Spherical organic microparticles having a number-average primary particle size of 10 to 2,000 nm are usable as organic microparticles. Specifically, there is usable styrene or methyl methacrylate homopolymer or their copolymers.

There are also usable lubricants, such as long chain fatty acid metal salts to achieve enhanced cleaning ability or transferability. Examples of a long chain fatty acid metal salt include zinc, aluminum, copper, magnesium, and calcium stearates; zinc, manganese, iron, copper and magnesium oleates; zinc, copper, magnesium, and calcium palmitates; zinc and calcium linolates; zinc and calcium ricinolates.

Such an external additive or lubricant is incorporated preferably in an amount of 0.1 to 10.0% by weight of the total toner. The external additive or lubricant can be incorporated by using commonly known mixing devices such as a turbuler mixer, a HENSCHEL mixer, a Nauter mixer or a V-shape mixer.

Developer of the Invention

The toner of the invention is usable as a two-component developer comprised of a carrier and a toner, or a nonmagnetic single-component developer comprised of a toner alone.

The use of the toner of the invention as a two-component developer enables full-color printing by using a tandem system image forming apparatus, as described later. Further, appropriate selection of a resin and a wax constituting a toner enables full-color printing corresponding to low-temperature fixing in which a paper temperature is approximately 100° C. in fixing.

Magnetic particles used as a carrier of a two-component developer can use commonly known materials, e.g., metals such as iron, ferrite and magnetite and alloys of the foregoing metals and metals such as aluminum or lead. Of these, ferrite particles are preferred. The volume-average particle size of a carrier of a carrier is preferably from 15 to 100 μm. and more preferably from 25 to 80 μm.

When used as a nonmagnetic single-component developer without a carrier to perform image formation, a toner is charged with being rubbed or pressed onto a charging member or the developing roller surface. Image formation in a nonmagnetic single-component development system can simplify the structure of a developing device, leading to a merit of compactification of the whole image forming apparatus. Therefore, the use of the toner of the invention as a single-component developer can achieve full-color printing in a compact printer, making it feasible to prepare full-color prints of superior color reproduction even in a space-limited working environment.

Image Forming Method

There will be described image formation using the toner of the invention. First, there will be described image formation using the toner of the invention as a two-component developer.

FIG. 1 illustrates an example of an image forming apparatus in which the toner of the invention is usable as a two-component developer.

In FIG. 1, 1Y, 1M, 1C and 1K each designate photoreceptors; 4Y, 4M, 4C and 4K each designate a developing means; 5Y, 5M, 5C and 5K each designate primary transfer rollers; 5A designates a secondary transfer roller; 6Y, 6M, 6C and 6K each designate cleaning means; the numeral 7 designates an intermediate transfer unit; the numeral 24 designates a thermal roll type fixing device; and the numeral 70 designates an intermediate transfer material.

This image forming apparatus is called a tandem color image forming apparatus, which is, as a main constitution, composed of plural image forming sections 10Y, 10M, 10C and 10B, an intermediate transfer material unit 7 including an endless belt form of a transfer belt, paper feeding and conveying means 22A to 22D to convey recording member P and heated roll-type fixing device 24. Original image reading device SC is disposed in the upper section of image forming apparatus body A.

Image forming section 10Y to form a yellow image on the drum-form photoreceptor 11Y; electrostatic-charging means 2Y, exposure means 3Y and developing means 4Y which are disposed around the photoreceptor 1Y; primary transfer roller 5Y; and cleaning means 6Y.

Image forming section 10M to form a magenta image on the drum-form photoreceptor 1M; electrostatic-charging means 2M, exposure means 3M and developing means 4M which are disposed around the photoreceptor 1M; primary transfer roller 5M; and cleaning means 6M.

Image forming section 10C to form a cyan image on the drum-form photoreceptor 1C; electrostatic-charging means 2Y, exposure means 3C and developing means 4C which are disposed around the photoreceptor 1C; primary transfer roller 5C; and cleaning means 6C.

Image forming section 10K to form a black image on the drum-form photoreceptor 1K; electrostatic-charging means 2K, exposure means 3K and developing means 4K which are disposed around the photoreceptor 1K; primary transfer roller 5K; and cleaning means 6K.

Intermediate transfer unit 7 of an endless belt form is turned by plural rollers has intermediate transfer material 70 as the second image carrier of an endless belt form, while being pivotably supported.

The individual color images formed in image forming sections 10Y, 10M, 10C and 10K are successively transferred onto the moving intermediate transfer material (70) of an endless belt form by primary transfer rollers 5Y, 5M, 5C and 5K, respectively, to form a composite color image. Recording member P of paper or the like, as a final transfer material housed in paper feed cassette 20, is fed by paper feed and conveyance means 21 and conveyed to secondary transfer roller 5A through plural intermediate rollers 22A, 22B, 22C and 22D and resist roller 23, and color images are transferred together on recording member P. The color image-transferred recording member (P) is fixed by heat-roll type fixing device 24, nipped by paper discharge roller 25 and put onto paper discharge tray 26 outside a machine.

After a color image is transferred onto recording member P by secondary transfer roller 5A, intermediate transfer material 70 which separated recording member P removes any residual toner by cleaning means 6A.

The primary transfer roller 5K is always compressed to the photoreceptor 1K. Other primary rollers 5Y, 5M and 5C are each the photoreceptors 1Y, 1M and 1C, respectively, only when forming color images.

Secondary transfer roller 5A is compressed onto intermediate transfer material 70 only when recording member P passes through to perform secondary transfer.

Housing 8, which can be pulled out from the apparatus body (A) through supporting rails 82L and 82R, is comprised of image forming sections 10Y, 10M, 10C and 10K and the intermediate transfer unit (7) of an endless belt form.

Image forming sections 10Y, 10M, 10C and 10K are arranged vertically in a line. Intermediate transfer material unit 7 of an endless belt form is disposed on the left side of photoreceptors 1Y, 1M, 1C and 1K. Intermediate transfer material unit 7 comprises the intermediate transfer unit 7 of an endless belt form which can be turned via rollers 71, 72, 73, 74 and 76, primary transfer rollers 5Y, 5M, 5C and 5K and cleaning means 6A.

The image forming sections 10Y, 10M, 10C and 10K and the intermediate transfer unit 7 are pulled out of the body A by pulling the housing 8.

In the process of image formation, toner images are formed on photoreceptors 1Y, 1M, 1C and 1K, through electrostatic-charging, exposure and development, toner images of the individual colors are superimposed on the endless belt form, intermediate transfer material 70, transferred together onto recording member P and fixed by compression and heating in heat-roll type fixing device 24. After completion of transferring a toner image to recording member P, intermediate transfer material 70 cleans any toner remained on the intermediate transfer material by cleaning device 6A and then goes into the foregoing cycle of electrostatic-charging, exposure and development to perform the subsequent image formation.

Figure 2:
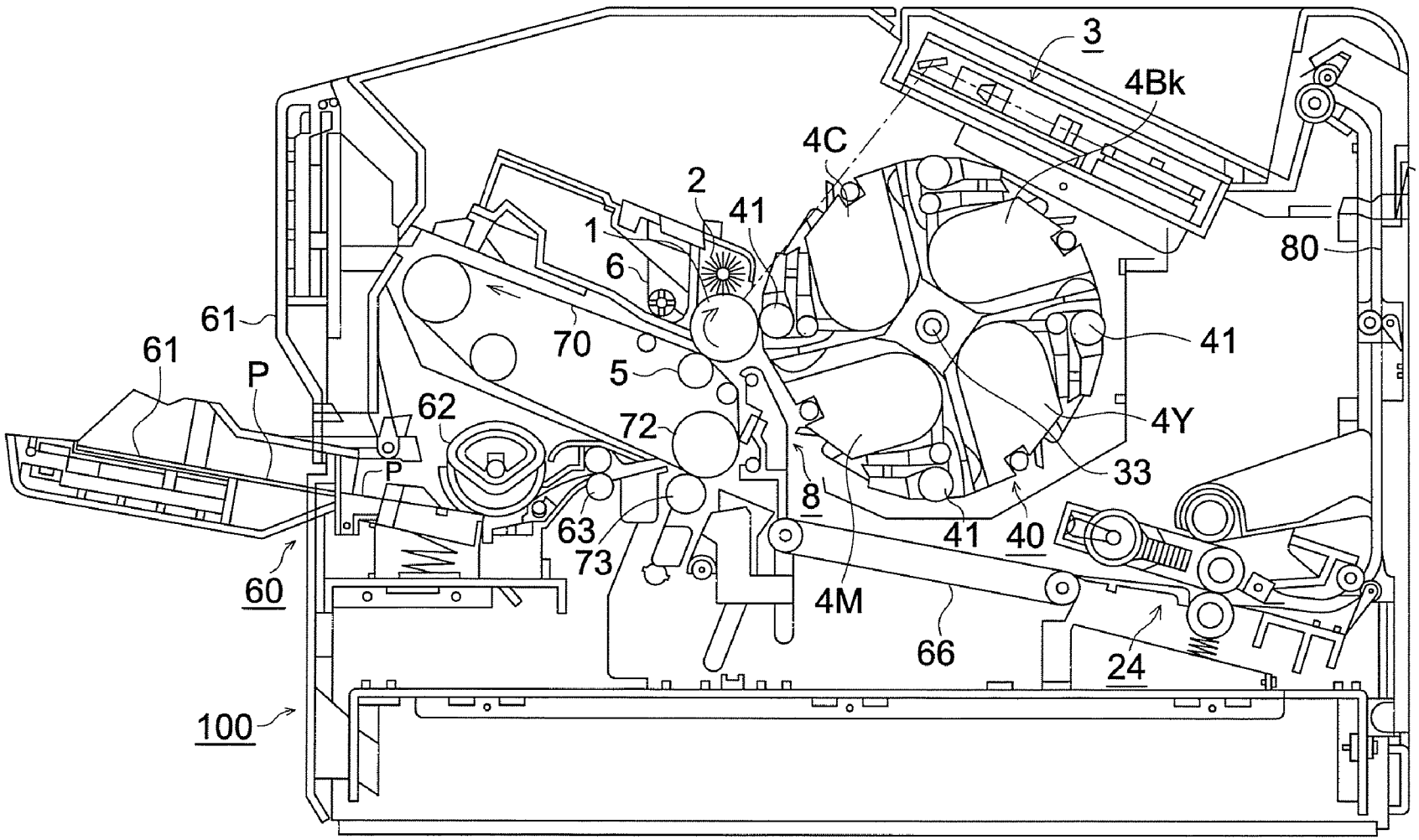
FIG. 2 illustrates an example of a four-cycle type full-color image forming apparatus in which image formation of a non-magnetic single-component development system is feasible.

Next, there will be described an image forming method using the toner of the invention as a nonmagnetic single-component developer. FIG. 2 illustrates an example of a full-color image forming apparatus using a nonmagnetic single-component developer. In the image forming apparatus of FIG. 2, there are provided, around a rotary-drivable electrostatic latent image bearing body 1 (hereinafter, also denoted as a photoreceptor drum 1), an electrostatic-charging brush 2 to allow the surface of the photoreceptor drum 1 to be uniformly charged to a prescribed potential and a cleaner 6 to remove any residual toner on the photoreceptor drum 1.

A laser scanning optical system 3 scanning-exposes the surface of the photoreceptor drum 1 uniformly charged by the charging brush 2 to form a latent image on the photoreceptor drum. A laser scanning optical system 3 incorporates a laser diode, a polygon mirror and an fθ optical system, with the control section of which print data for each of yellow, magenta, cyan and black are transferred from a host computer. Based on the print data for the respective colors, laser beams are successively outputted to scan the surface of the photoreceptor drum 1 to form an electrostatic latent image of each color.

A development device unit 40, housing a development device 4, supplies the individual color toners to the photoreceptor drum 1 to perform development. The development device unit 40 is provided with four development devices 4Y, 4M, 4C and 4Bk which house nonmagnetic single-component toners of yellow, magenta, cyan and black, respectively, and rotate centering around a shaft 33 to guide the individual development device 4 to the position opposing the photoreceptor drum 1.

The development device unit 40 rotates centering around the shaft 33 every time an individual electrostatic latent image is formed on the photoreceptor drum 1 by the laser scanning optical system 3, and guiding the development device housing a corresponding color toner to the position opposing the photoreceptor drum 1. Then, the respective charged color toners are successively supplied from each of the development devices 4Y, 4M, 4C and 4Bk to perform development.

In the image forming apparatus of FIG. 2, an endless intermediate transfer member 70 is provided on the downstream side in the rotation direction of the photoreceptor drum 1 from the development device unit 40 and is rotated in synchronization with the photoreceptor drum 1. The intermediate transfer member 70 is in contact with the photoreceptor drum 1 with being pressed by a primary transfer roller 5 to transfer the toner image formed on the photoreceptor drum 1. A secondary rotating transfer roller 73 is provided opposite a support roller 72 to support the intermediate transfer member 70 and a toner image carried on the intermediate transfer member 70 is transferred onto a recording material P such as recording paper by being pressed at the site opposing the secondary transfer roller 73.

Between the full-color developing device unit 40 and the intermediate transfer member 70, a cleaner 8 to remove any residual toner remained on the intermediate transfer member 70 is provided with being detachable from the intermediate transfer member 70.

A paper feeding means 60 for guiding the recording material (P) to the intermediate transfer member 70 is constituted of a paper-feeding tray 61 housing recording material P, a paper-feeding 62 to feed the recording material P housed in the paper-feeding tray 61, sheet-by-sheet and a timing roller 63 to transfer the fed recording material P to the secondary transfer site.

The recording material P onto which a toner image has been transferred by being pressed is conveyed to a fixing device 24 through a conveyance means 66 constituted of an air-suction belt or the like, after which the transferred toner image is fixed on the recording material P in the fixing device 24. After fixing, the recording material P is conveyed through vertical conveyance route 80 and discharged onto the upper surface of apparatus body 100.

The image forming apparatus of FIG. 2 performs image formation with loading exchangeable development devices 4Y, 4M, 4C and 4Bk. A development device, which is usually also called a toner cartridge, contains a prescribed amount of a toner within it where parts such as a developing roller are disposed. A development device, supplied in a cartridge form is mounted at a prescribed position within the image forming apparatus and supplies the contained developer to the photoreceptor drum to perform development. When no more developer remains after performing image formation of prescribed sheets, the cartridge is detached from the device and a new cartridge is loaded.

EXAMPLE

The embodiments of the invention will be described with reference to examples but the invention is by no means limited to these.

1. Preparation of Cyan Toners 1 to 12 and Comparative Cyan Toners 13 to 16

1-1. Preparation of Cyan Toner 1 (Pulverization Method)

The toner constitution described below was placed in a HENSCHEL mixer (produced Mitsui-Miike Kogyo Co., Ltd.) and mixed with stirring at a blade-circumferential speed of 25 m/sec for 5 min.

| | |
|---|---|
| Polyester resin (condensation product of bisphenol A/ethylene oxide adduct, terephthalic acid and trimeritic acid having a weight average molecular weight of 20,000) | 100 mass parts |
| Colorant I-1 | 4 mass parts |
| Releasing agent Pentaerythritol tetrastearate | 6 mass parts |
| Boron dibenzylic acid (charge controlling agent) | 1 mass part |

The mixture was kneaded by a biaxial extrusion kneader, roughly pulverized by a hammer mill, further pulverized by a turbo-mill (produced by TURBO KOGYO Co., Ltd.) and was subjected to a fine powder classification treatment by an air classifier employing Coanda effect to obtain colored particles having a volume-based median diameter of 5.5 μm, and volume based CV value of 23.8.

Next, to the foregoing colored particles were added external additives described below and subjected to an external treatment by HENSCHEL mixer to obtain Cyan Toner 1.

| | |
|---|---|
| Hexamethylsilane-treated silica (average primary particle size of 12 nm) | 0.6 mass parts |
| n-Octylsilane-treated titanium oxide (average primary particle size of 24 nm) | 0.8 mass parts |

The external treatment in HENSCHEL mixer was conducted under conditions of a stirring blade circumferential speed of 35 m/sec, a treatment temperature of 35° C. and a treatment time of 15 min.

1-2. Preparation of Cyan Toners 2-12 and Comparative Cyan Toners 13-16

Toners were prepared according to the emulsion coagulation method.

Preparation of Cyan Colorant Microparticle Dispersion (a) Preparation of Cyan Colorant Microparticle Dispersion 2

Sodium n-dodecylsulfate in an amount of 11.5 parts by mass was placed in 160 parts by mass of deionized water and dissolved with stirring to prepare an aqueous surfactant solution. To the aqueous surfactant solution was added gradually 6 parts by mass of Compound I-2 as shown in Table 1 and dispersed by using CLEARMIX W-motion CLM-0.8 (produced by M Technique Co.) to obtain cyan colorant microparticle dispersion 2.

Colorant microparticle 2 contained in the Cyan Colorant microparticle dispersion 2 exhibited a volume-based median diameter of 98 nm. The volume-based median diameter was measured by using MICROTRAC UPA-150 (produced by HONEYWELL Corp.) under the following condition:

Sample refraction index: 1.59

Sample specific gravity: 1.05 (equivalent converted to spherical particle)

Solvent refraction index: 1.33

Solvent viscosity: 0.797 Pa·S (30° C.), 1.002 Pa·S (20° C.)

Zero-point adjustment: adjustment by adding deionized water to a measurement cell.

(b) Preparation of Cyan Colorant Microparticle Dispersions 3 to 12 and Comparative Cyan Colorant Microparticle Dispersions 13 to 15

Sodium n-dodecylsulfate in an amount of 11.5 parts by mass was placed in 160 parts by mass of deionized water and dissolved with stirring to prepare an aqueous surfactant solution. To the aqueous surfactant solution was added gradually 6 parts by mass of Compound I-3 through I-12 as shown in Table 1 and dispersed by using CLEARMIX W-motion CLM-0.8 (produced by M Technique Co.) to obtain Cyan Colorant microparticle dispersions 3-12. Comparative Cyan Colorant microparticle dispersions 13-15 were prepared in the similar way by employing Comparative Colorants I-13 through I-15.

(c) Preparation of Cyan Colorant Microparticle Dispersion 16

Cyan colorant microparticle dispersion 16 was prepared in the similar way as Cyan Colorant microparticle dispersion 2, except that C.I. Pigment Blue 15:3 was used in place of the same amount of I-2.

1-2-1. Preparation of Core Resin Particle (1) First Polymerization (Formation of Nuclear Particles)

Into a reaction vessel fitted with a stirrer, a temperature sensor, a condenser and a nitrogen gas-introducing device was added 4 parts by mass of anionic surfactant P together with 3,040 parts by mass of deionized water to prepare an aqueous surfactant solution, which was stirred at 230 rpm under nitrogen gas circumstances and the temperature was raised to 80° C.

P: $C_{10}H_{21}(OCH_2CH_2)_2SO_3Na$

To the foregoing aqueous surfactant solution was added a polymerization initiator solution of 10 parts by weight of potassium persulfate (KPS) dissolved in 400 parts by weight of deionized water and after the temperature was raised to 75° C., a mixed monomer solution comprised of the following compounds was dropwise added to the reaction vessel in 1 hr.

| | |
|---|---|
| Styrene | 532 mass parts |
| n-Butyl acrylate | 200 mass parts |
| Methacrylic acid | 68 mass parts |
| n-Octylmercaptan | 16.4 mass parts |

After completing addition of the foregoing monomer solution, the reaction mixture was heated with stirring at 75° C. for 2 hrs. to undergo polymerization (1st polymerization) to obtain resin particles dispersion A1. The dispersion A1 had a weight-average molecular weight of 16,500, and volume based median particle diameter of 89 nm.

(2) Second Polymerization (Formation Intermediate Layer)

To a flask fitted with a stirrer was added a mixed monomer solution of compounds describe below and subsequently, 93.8 parts by weight of paraffin wax HNP-57 (produced Nippon Seiro Co., Ltd.) as a releasing agent was added and dissolved with heating at 80° C. to prepare a monomer solution.

| | |
|---|---|
| Styrene | 101.1 mass parts |
| n-Butyl acrylate | 62.1 mass parts |
| Methacrylic acid | 12.3 mass parts |
| n-Octylmercaptan | 1.75 mass parts |

An aqueous surfactant solution was prepared by dissolving 3 parts by mass of the foregoing anionic surfactant (P) in 1,560 parts by mass of deionized water and heated at 80° C. To this aqueous surfactant solution was added the foregoing particulate resin A1 in an amount of 32.8 parts by mass (equivalent converted to solids), and the paraffin wax-containing monomer solution described above was added and was dispersed for 8 hrs. using a mechanical stirrer having a circulation pass, CLEARMIX (produced by M Technique Co.). There was thus prepared an emulsified particle dispersion comprised of emulsion particles.

Subsequently, to the foregoing emulsified particle dispersion was added a polymerization initiator solution of 6 parts by mass of potassium persulfate dissolved in 200 parts by mass of deionized water. This reaction mixture was heated at 80° C. for 3 hrs. to undergo polymerization (2nd polymerization) to prepare resin particles A2. The thus prepared resin particles were designated as particulate resin A2. The weight-average molecular weight of the particulate resin A2 was 23,000, and a volume based median particle diameter was 102 nm.

(3) Third Polymerization:

To the particulate resin A2 obtained in the 2nd polymerization step was added a polymerization initiator solution of 5.45 parts by mass of potassium persulfate dissolved in 220 parts by mass of deionized water and a mixed monomer solution composed of the following compounds was dropwise added to the reaction vessel at 80° C. in 1 hr.

| | |
|---|---|
| Styrene | 293.8 mass parts |
| n-Butyl acrylate | 154.1 mass parts |
| n-Octylmercaptan | 7.08 mass parts |

After completing addition, the reaction mixture was heated with stirring for 2 hrs. to undergo polymerization (3rd polymerization). After completing polymerization, the reaction mixture was cooled to 28° C. to obtain latex A3 of core resin particles A3. The weight-average molecular weight of the core resin particles A3 was 26,800. The volume based median particle diameter of the composite resin particles composing core resin particles A3 was 125 nm. Glass transition temperature (Tg) of core resin particles A3 was 28.1° C.

1-2-2. Preparation of Resin Particle for Forming Shell:

Shell resin particles F were prepared similarly to the foregoing core resin particles A1 (nuclear particles), provided that the composition of the monomer solution used in the 1st polymerization step was changed as below.

| | |
|---|---|
| Styrene | 624 mass parts |
| 2-Ethylhexyl acrylate | 120 mass parts |
| Methacrylic acid | 56 mass parts |
| n-Octylmercaptan | 16.4 mass parts |

The weight-average molecular weight of the shell forming particles F was 16,400. The volume based median particle diameter was 95 nm of the shell forming resin particles F was 95 nm. Glass transition temperature (Tg) of shell forming resin particles F was 62.6° C.

1-3. Preparation of Cyan Toner 2

Cyan toner 2 was prepared according to the procedure below.

(1) Formation of Core:

Into a reaction vessel fitted with a stirrer, a temperature sensor, a condenser and a nitrogen gas introducing device was placed the following composition:

| | |
|---|---|
| Core resin particle A3 (equivalent converted to solid) | 420.7 mass parts |
| Deionized water | 900 mass parts |
| Colorant particle dispersion 1 | 200 mass parts |

The interior of the reaction vessel was adjusted to 30° C. and the pH was adjusted to 10 with an aqueous 5 mol/L sodium hydroxide solution.

Subsequently, further thereto, an aqueous solution of 2 parts by mass of magnesium chloride hexahydrate dissolved in 1000 parts by weight of deionized water was added at 30° C. for 10 min. After allowed to stand for 3 min., the mixture was heated to 65° C. in 60 min. to perform coagulation. Using MULTISIZER 3 COULTER COUNTER (Beckman Coulter, Inc.), the dispersion was measured as such with respect to coagulated particle size and when coagulated particles reached a volume-based median diameter of 5.5 μm, there was added an aqueous solution of 40.2 parts by mass of sodium chloride dissolved in 1,000 parts by mass of deionized water to terminate coagulation.

After terminating coagulation, ripening was conducted at 70° C. for 1 hr. to allow fusion to continue, whereby core 1 was prepared. The average circularity of the core particle 1, which was measured by FPIA 2000 (produced by SYSTEX Co. Ltd.), was 0.962. A volume based median particle diameter of the core 1 was 5.5 μm.

(2) Formation of Shell:

Next, to the foregoing solution maintained at 65° C. was added 96 parts by mass of shell resin particle F. Further thereto, an aqueous solution of 2 parts by mass of magnesium chloride hexahydrate dissolved in 1,000 parts by mass of deionized water was added in 10 min. and the reaction mixture was heated to 70° C. (shelling temperature) and stirred for 1 hr. Thus, the shell resin particle 1 was fused onto the surface of the core particle 1 and ripening was carried out for 20 min to form a shell.

Thereafter was added an aqueous solution of 40.2 parts by mass of sodium chloride dissolved in 1,000 parts by mass to terminate shell formation. The reaction mixture was cooled to 30° C. at a cooling rate of 6° C./min. The colored particles thus formed were filtered off and repeatedly washed with deionized water of 45° C., and dried with hot air of 40° C. to form a shell on the core surface. Cyan Toner 2 was prepared by external additive treatment as Cyan Toner 1. The average circularity measured by FPIA 2000 was 0.966, a volume based median particle diameter was 5.7 μm and a volume based median CV value was 18.2.

1-3. Preparation of Cyan Toners 3 to 12 and Comparative Cyan Toners 13 to 16

Cyan toners 3 to 12 and comparative cyan toners 13 to 16 were prepared similarly to the foregoing toner 2, provided that the cyan colorant microparticle dispersion 2 was replaced by either one of cyan colorant microparticle dispersion 3 to 16 as shown in Table 1.

Comparative phthalocyanine colorants used in the samples 13 to 15 are shown below.

I-13

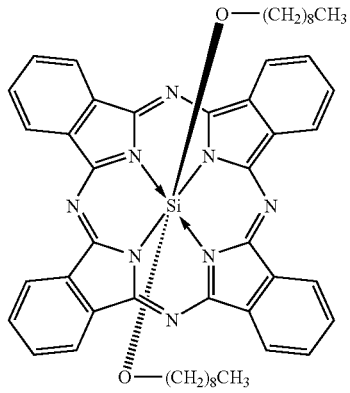

-continued

I-14

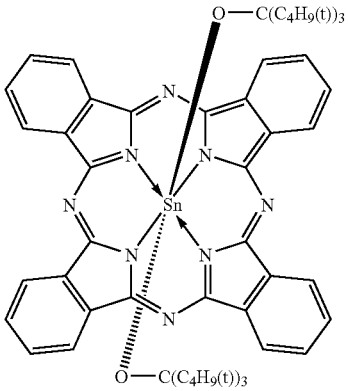

I-15

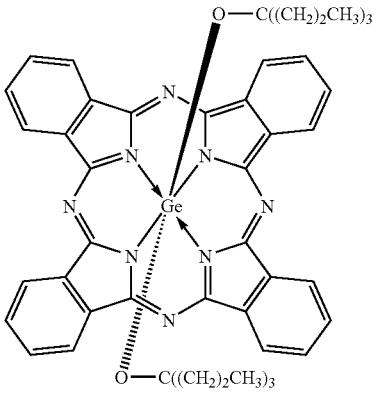

TABLE 1

| Cyan toner No. | Compound No. |
|---|---|
| 1 | I-1 |
| 2 | I-2 |
| 3 | I-3 |
| 4 | I-4 |
| 5 | I-5 |
| 6 | I-6 |
| 7 | I-7 |
| 8 | I-8 |
| 9 | I-9 |
| 10 | I-10 |
| 11 | I-11 |
| 12 | I-12 |
| 13 | C-13 |
| 14 | C-14 |
| 15 | C-16 |
| 16 | C.I. Pigment Blue 15:3 |

2. Preparation of Yellow Toner

Preparation of Yellow Colored Minute Dispersion 1

Sodium n-dodecylsulfate in an amount of 11.5 parts by mass was placed in 160 parts by mass of deionized water and dissolved with stirring to prepare an aqueous surfactant solution. To the aqueous surfactant solution was added gradually 17.5 parts by mass of Pigment Yellow 65 and 7.5 parts by mass of Pigment Yellow 83 and dispersed by using CLEARMIX W-motion CLM-0.8 (produced by M Technique Co.) to obtain yellow colorant microparticle dispersion. Volume base median particle diameter of the yellow colorant microparticles was 126 nm.

The volume-based median diameter was measured by using MICROTRAC UPA-150 (produced by HONEYWELL Corp.) under the following condition:

Sample refraction index: 1.59

Sample specific gravity: 1.05 (equivalent converted to spherical particle)

Solvent refraction index: 1.33

Solvent viscosity: 0.797 Pa·S (30° C.), 1.002 Pa·S (20° C.)

Zero-point adjustment: adjustment by adding deionized water to a measurement cell.

Preparation of Yellow Toner 1

Yellow Toner 1 was prepared in the same way as preparation of Cyan Toner No. 2, except that cyan colored minute dispersion 2 was changed to yellow colored minute dispersion 1.

Preparation of Magenta Toner

Preparation of Magenta Colored Minute Dispersion 1

Sodium n-dodecylsulfate in an amount of 11.5 parts by mass was placed in 160 parts by mass of deionized water and dissolved with stirring to prepare an aqueous surfactant solution. To the aqueous surfactant solution was added gradually 9 parts by mass of C.I. Solvent Red 49 and dispersed by using CLEARMIX W-motion CLM-0.8 (produced by M Technique Co.) to obtain yellow colorant microparticle dispersion. Volume base median particle diameter of the magenta colorant microparticles was 66 nm.

The volume-based median diameter was measured by using MICROTRAC UPA-150 (produced by HONEYWELL Corp.).

3. Preparation of Magenta Toner 1

Magenta Toner 1 was prepared in the same way as preparation of Cyan Toner No. 2, except that cyan colored minute dispersion 2 was changed to magenta colored minute dispersion 1.

Evaluation Condition

Preparation of Developer

Two component developers Cyan Developers 1-12, Comparative Cyan Developers 13-16, Yellow Developer 1, and Magenta Developer 1 were prepared by blending silicone resin coated ferrite carrier having a volume average particle size of 50 mm so that the toner density was 6% by mass in each developer.

Experiments were conducted by employing Cyan Developers 1-12, Comparative Cyan Developers 13-16 respectively and Yellow Developer 1, and Magenta Developer 1 in combination.

The following tests (1)-(3) were practiced by employing a full color high speed composite machine Bizhub PRO C650, manufactured by Konica Minolta Business Technologies. Inc., in which print image forming test was conducted in a condition of fixing line speed of 310 mm/min (about 65 sheets per min.).

POD gloss coated paper 128 g/m$^2$ (manufactured by Oji Paper Co., Ltd.) was employed as the transfer paper. The result was summarized in Table 2.

Evaluation Items (1) Transparency

Transparency of OHT image was evaluated by the following method. Visible spectral transmittance image was measured at 450 nm by employing 330 Hitachi Spectrophotometer (by Hitachi Ltd., wherein OHT sheet having no toner was used as a reference for measure of transparency of OHT image. The larger the value, the better transparency the sample has.

(2) Color Change Due to Fixing Temperature

Cyan images having toner amount on the sheet of 0.4 mg/cm$^2$ were formed at fixing temperature from 140-220° C. in each 10° C. The image was analyzed by employing Color Eye 7000, manufactured by GretagMacbeth, with SCE mode wherein light source was ASTM-D65, and observing angular field of view was 2°. The color change was evaluated by difference of maximum and minimum B*of the images which were formed at fixing temperature from 140-220° C. in each 10° C. When the difference is large, color reproduction is not stable and there is gap in color matching, and therefore, required color is not obtained. The difference is required not more than 1.0 and preferably 0.5 practically.

(3) Evaluation of Color Tone of Light Blue or Blue Logo Mark

Evaluation of color tone of light blue or blue logo mark was conducted in such way that the light blue or blue logo marks of 50 companies each was displayed by computer display down loaded from home page of each company, then they were printed on transfer paper "Japanese Paper Copy Daio" manufactured by Ozu Corp. Evaluation was carried out based on the number out of 100 randomly selected panelists aged between teens—seventies, who evaluated that the color of the logos on the transfer sheet was reproduced without any uncomfortable feeling.

(Computer)

iMac (Apple Computer Co., Ltd.),
24-inch wide screen LCD,
resolution 1,920×1,200 pixels,
2.16 GHz Intel Core 2 Duo processor 1,
4 MB shared secondary cache,
1 GB memory (2×512 MB SO-DIMM),
250 GB serial ATA hard drive,
8× double layer system Super Drive (DVD+R DL, DVD±RW, CD-RW),
NVIDIA GEFORCE 7300 GT 128 MB GDDR memory,
Air Mac Extreme, and built-in Bluetooth 2, and
Apple Remote

TABLE 2

| | Cyan Toner No. | Colorant No. | Transparency | Color change (*) | Color tone evaluation (**) |
|---|---|---|---|---|---|
| Example 1 | 1 | I-1 | 87 | 0.04 | 90 |
| Example 2 | 2 | I-2 | 91 | 0.02 | 90 |
| Example 3 | 3 | I-3 | 92 | 0.06 | 98 |
| Example 4 | 4 | I-4 | 92 | 0.03 | 97 |
| Example 5 | 5 | I-5 | 90 | 0.05 | 96 |
| Example 6 | 6 | I-6 | 89 | 0.11 | 88 |
| Example 7 | 7 | I-7 | 86 | 0.68 | 79 |
| Example 8 | 8 | I-8 | 85 | 0.77 | 77 |
| Example 9 | 9 | I-9 | 88 | 0.52 | 85 |
| Example 10 | 10 | I-10 | 88 | 0.76 | 86 |
| Example 11 | 11 | I-11 | 89 | 0.81 | 75 |
| Example 12 | 12 | I-12 | 89 | 0.55 | 79 |
| Comparative Example 13 | 13 | C-13 | 80 | 1.90 | 61 |
| Comparative Example 14 | 14 | C-14 | 69 | 2.10 | 18 |
| Comparative Example 15 | 15 | C-15 | 61 | 2.50 | 23 |
| Comparative Example 16 | 16 | Pigment Blue 15:3 | 64 | 0.90 | 32 |

(*) Color change due to fixing temperature
(**) Evaluation of color tone of light blue or blue logo mark
(Number of panelists who evaluated as good reproduction)

Samples of Examples 1-12 demonstrate good characteristics in any evaluation items. Samples of Comparative Examples 13-16 demonstrate have at least one problem in the evaluation items.

What is claimed is:

1. An electrophotographic toner comprising toner particles each containing a resin and a colorant, wherein the colorant is a compound represented by the formula (I):

formula (I)

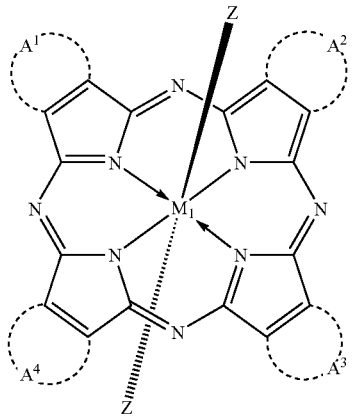

in the formula, $M_1$ is a silicon atom (Si); Z is independently a chlorine atom, a hydroxy group, or an alkoxy group having 1 to 5 carbon atoms; and $A^1$, $A^2$, $A^3$ and $A^4$ are each independently an atomic group of:

(a-1)

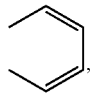

(a-2)

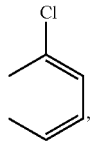

(a-3)

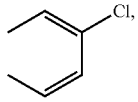

or (a-4)

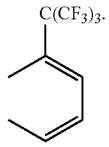

2. The electrophotographic toner of claim 1, wherein $A^1$, $A^2$, $A^3$ and $A^4$ are an atomic group of:

(a-1)

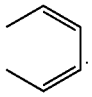

3. The electrophotographic toner of claim 1, wherein the colorant comprises one of a compound represented by I-1 through I-6

I-1

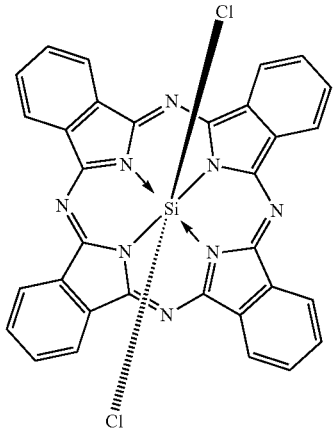

I-2

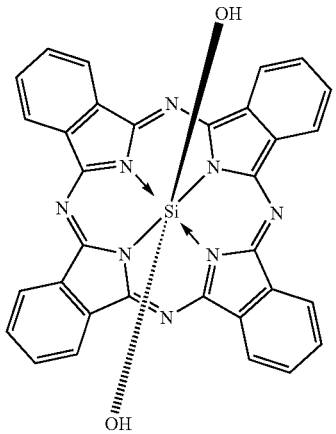

I-3

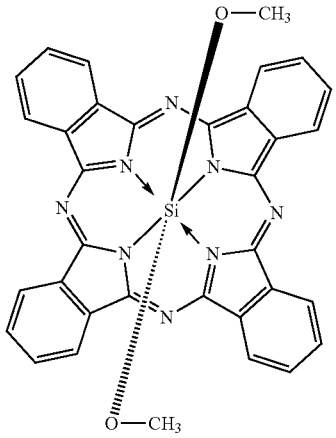

-continued

I-4

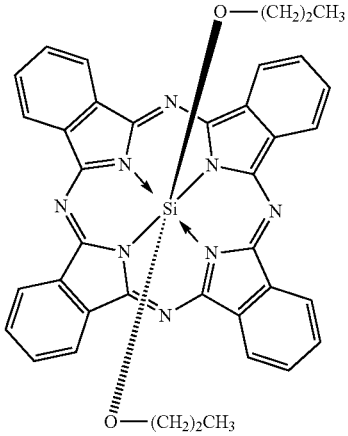

I-5

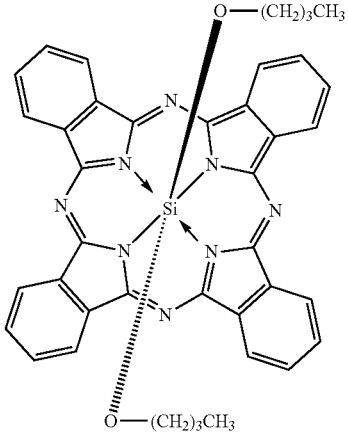

I-6

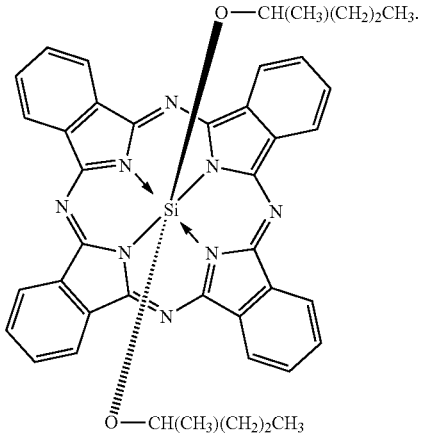

4. The electrophotographic toner of claim 1, wherein content of the compound represented by the formula (I) is from 2 to 10% by mass of total mass of the toner.

5. The electrophotographic toner of claim 1, wherein content of the compound represented by the formula (I) is from 4 to 8% by mass of total mass of the toner.

6. The electrophotographic toner of claim 1, wherein a particle diameter of the colorant in the toner particle is 24-1, 600 nm.

7. The electrophotographic toner of claim 6, wherein a particle diameter of the colorant in the toner particle is 60-700 nm.

8. The electrophotographic toner of claim 1, wherein a volume-based median diameter of the toner particles not less than 3 μm and not more than 8 μm.

* * * * *

UNITED STATES PATENT AND TRADEMARK OFFICE

CERTIFICATE OF CORRECTION

PATENT NO. : 8,053,153 B2
APPLICATION NO. : 12/267030
DATED : November 8, 2011
INVENTOR(S) : Mikio Kouyama et al.

It is certified that error appears in the above-identified patent and that said Letters Patent is hereby corrected as shown below:

Column 26, line 38, delete "50 mm" and insert --50 μm-- [should read: size of 50 μm so that the toner density was 6% by mass in].

Signed and Sealed this
Twenty-seventh Day of December, 2011

David J. Kappos

David J. Kappos
*Director of the United States Patent and Trademark Office*